US007645030B2

(12) United States Patent
Koseki

(10) Patent No.: US 7,645,030 B2
(45) Date of Patent: Jan. 12, 2010

(54) INK JET HEAD AND INK JET RECORDING APPARATUS

(75) Inventor: Osamu Koseki, Chiba (JP)

(73) Assignee: SII Printek Inc. (JP)

( * ) Notice: Subject to any disclaimer, the term of this patent is extended or adjusted under 35 U.S.C. 154(b) by 475 days.

(21) Appl. No.: 11/488,255

(22) Filed: Jul. 18, 2006

(65) Prior Publication Data

US 2007/0019035 A1 Jan. 25, 2007

(30) Foreign Application Priority Data

Jul. 20, 2005 (JP) ..... 2005-209872
Mar. 6, 2006 (JP) ..... 2006-059007

(51) Int. Cl.
*B41J 2/045* (2006.01)

(52) U.S. Cl. ..... 347/69

(58) Field of Classification Search ..... 347/69
See application file for complete search history.

(56) References Cited

U.S. PATENT DOCUMENTS 5,252,994 A * 10/1993 Narita et al. ..... 347/71
5,959,643 A * 9/1999 Temple et al. ..... 347/40
2002/0089574 A1 * 7/2002 Yamauchi et al. ..... 347/69

FOREIGN PATENT DOCUMENTS

| | | |
|---|---|---|
| DE | 4443254 | 12/1995 |
| EP | 0666174 | 8/1995 |
| JP | 10264390 | 10/1998 |

* cited by examiner

*Primary Examiner*—Stephen D Meier
*Assistant Examiner*—Geoffrey Mruk
(74) *Attorney, Agent, or Firm*—Adams & Wilks

(57) ABSTRACT

An ink jet head has a plurality of individual head chips integrated to form a head chip block. Each head chip has a plurality of grooves, and the grooves of all the head chips open at one end to respective nozzle holes formed in a nozzle plate. Each head chip has an actuator substrate in which is formed an ink chamber that supplies ink to the grooves in that head chip. An ink flow path connects an ink supply to one of the ink chambers in one of the head chips, and the ink chambers of all the head chips communicate with one another through ink holes. Since ink is supplied to the grooves of all the head chips from a single ink flow path connected to the ink supply, the size of the ink jet head, particularly in the thickness direction, the weight, the number of parts and the manufacturing cost can all be reduced.

20 Claims, 13 Drawing Sheets

INK JET HEAD AND INK JET RECORDING APPARATUS

BACKGROUND OF THE INVENTION

1. Field of the Invention

The present invention relates to an ink jet head employed for an ink jet recording apparatus that discharges ink droplets to record images on a recording medium.

2. Related Background Art

Conventionally, an ink jet recording apparatus is known that records characters and images on a recording medium by employing an ink jet head that includes a plurality of nozzles from which ink is discharged. The type of ink jet head frequently employed includes, as a single unit, multiple nozzles, pressure generators and ink guide holes, and an ink jet head wherein multiple arrays of nozzles and pressure generator arrays are provided is well known. FIG. 12 is a schematic cross-sectional view of an example ink jet head unit wherein two nozzle arrays are arranged with their positions shifted relative to each other. FIG. 13 is a plan view of a head chip block, and FIG. 14 is a schematic cross-sectional view of the entire ink jet head.

As shown in FIG. 12, a plurality of parallel grooves 3 are formed in piezoelectric ceramic plates 2 and 5, and are separated by side walls. One longitudinal end of each groove 3 is extended to one end face of the piezoelectric ceramic plate 2 or 5, while the other end is not extended to the other end face, so that the depth of the grooves 3 is gradually reduced.

Ink chamber plates 7 and 10, which form common ink chambers 32 and 33 that communicate with the shallow side ends of the grooves 3, are connected to the sides of the piezoelectric ceramic plates 2 and 5 where the grooves 3 are opened. Thus, two head chips are provided. The piezoelectric ceramic plates 2 and 5 of the two head chips are bonded together to obtain a head chip block 50.

A nozzle plate 15 is adhered to the end face of the head chip block 50, and nozzle holes 16 are formed in the nozzle plate 15 at locations corresponding to the grooves 3. The nozzle plate 15 and the head chip block 50 are fixed together by a head cap 17, and electrodes that are formed on the piezoelectric ceramic plates 2 and 5 are connected to a drive circuit board by a flexible board.

Furthermore, ink flow paths 34 and 35, for supplying ink to the common ink chambers 32 and 35, are secured to the two ink chamber plates 7 and 10, and ink guide joints 39 and 40 are formed in the center of the ink flow paths 34 and 5 in order to introduce ink. Further, pressure relaxing units 41 and 42 are connected to the ink guide joints 39 and 40 to absorb the pressure fluctuation that occurs during printing. In addition, filters 36 and 37 are fixed to the ink flow paths 34 and 35 to prevent foreign substances from entering the nozzle holes 16.

In the thus arranged ink jet head, ink is supplied to the individual grooves 3 via the pressure relaxing units 41 and 42 and the ink flow paths 34 and 35, and when a predetermined drive field is applied, the volumes of the grooves 3 are changed and ink in the grooves 3 is discharged from the nozzle holes 16. That is, the ink flow path 34 and the path along which ink is supplied to the ink chamber plate 7 and the piezoelectric ceramic plate 2 forms a set. Similarly, the ink flow path 35 and the path along which ink is supplied to the ink chamber plate 10 and the piezoelectric ceramic plate 5 forms a set. These sets are independent of each other, i.e., two ink flow paths are provided for the laminated head chip block 50.

However, according to the conventional ink jet head, the ink flow path 34 and the path along which ink is supplied to the ink chamber plate 7 and the piezoelectric ceramic plate 2 form a set, while the ink flow path 35 and the path along which the ink is supplied to the ink chamber plate 10 and the piezoelectric ceramic plate 5 form another set, and these two sets are independent of each other. Thus, two ink flow paths are required for one head chip block 50, and accordingly, two pressure relaxing units must respectively be provided. Therefore, the size of the ink jet head in the direction of thickness is increased, and the weight can not be reduced. Moreover, the number of parts is increased, and the manufacturing cost is increased.

When an ink jet recording apparatus is to be provided by mounting a plurality of such ink jet heads, the attachment area is extended, and also, the weight is increased.

SUMMARY OF THE INVENTION

To resolve these shortcomings, the objective of the present invention is to enable the reduction of the size and weight of an ink jet head, and to provide an ink jet head, at a low cost, and an ink jet recording apparatus.

To achieve this objective, according to one aspect of the present invention, an ink jet head comprises:

at least one first head chip, having a first actuator substrate, in which a plurality of parallel grooves are formed that communicate with nozzle holes, a first ink chamber plate, in which a first ink chamber is formed to supply ink to the each grooves; and equal to or greater than one second head chip including an ink flow path for connecting an ink supply portion to the first ink chamber, a second actuator substrate, in which a plurality of parallel grooves are formed to communicate with nozzle holes, a second ink chamber plate, in which a second ink chamber is formed to supply ink to the grooves in the second actuator substrate, and ink supply means for connecting the ink flow path to the second ink chamber. With this arrangement, ink can be supplied to a head chip that is not directly connected to the ink supply means.

As described above, according to the invention, when ink is introduced via one ink flow path, this ink can be guided to all the head chips that constitute a head chip block. Thus, the size and weight of the ink jet head can be reduced, and also, the number of parts can be reduced. As a result, an ink jet head at a low price can be provided.

DETAILED DESCRIPTION OF THE PREFERRED EMBODIMENTS

The present invention will now be described in detail by referring to the preferred embodiments.

Figure 1:
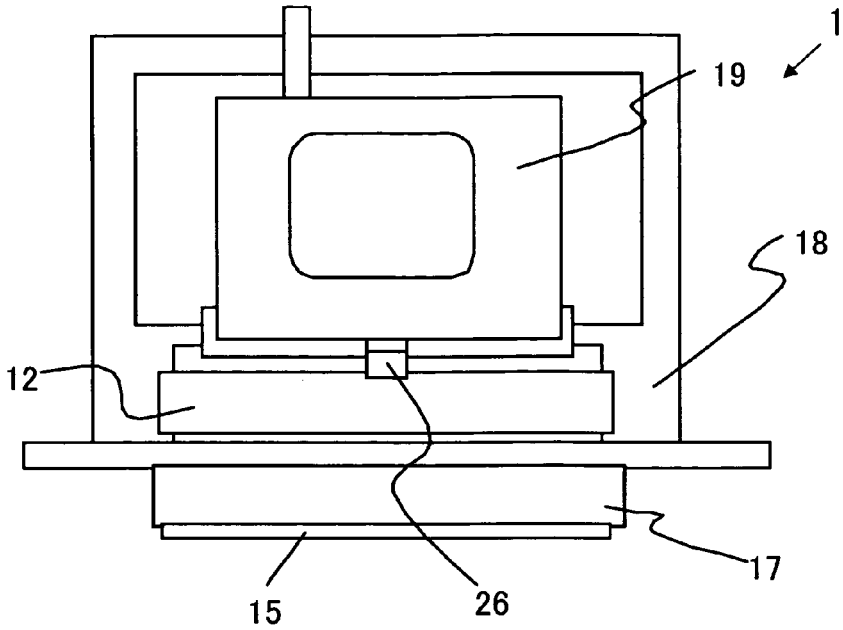
FIG. 1 is a front view of the entire ink jet head according to a first embodiment of the present invention.
Figure 2:
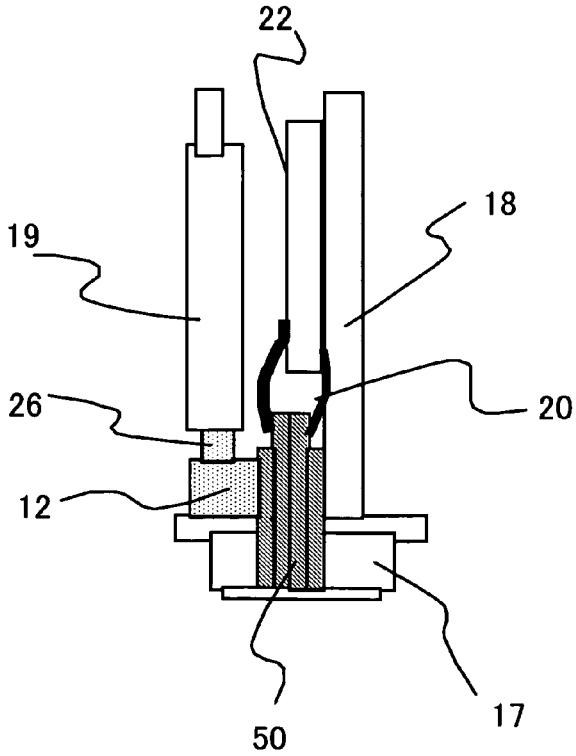
FIG. 2 is a schematic cross-sectional view of the entire ink jet head according to the first embodiment.
Figure 3:
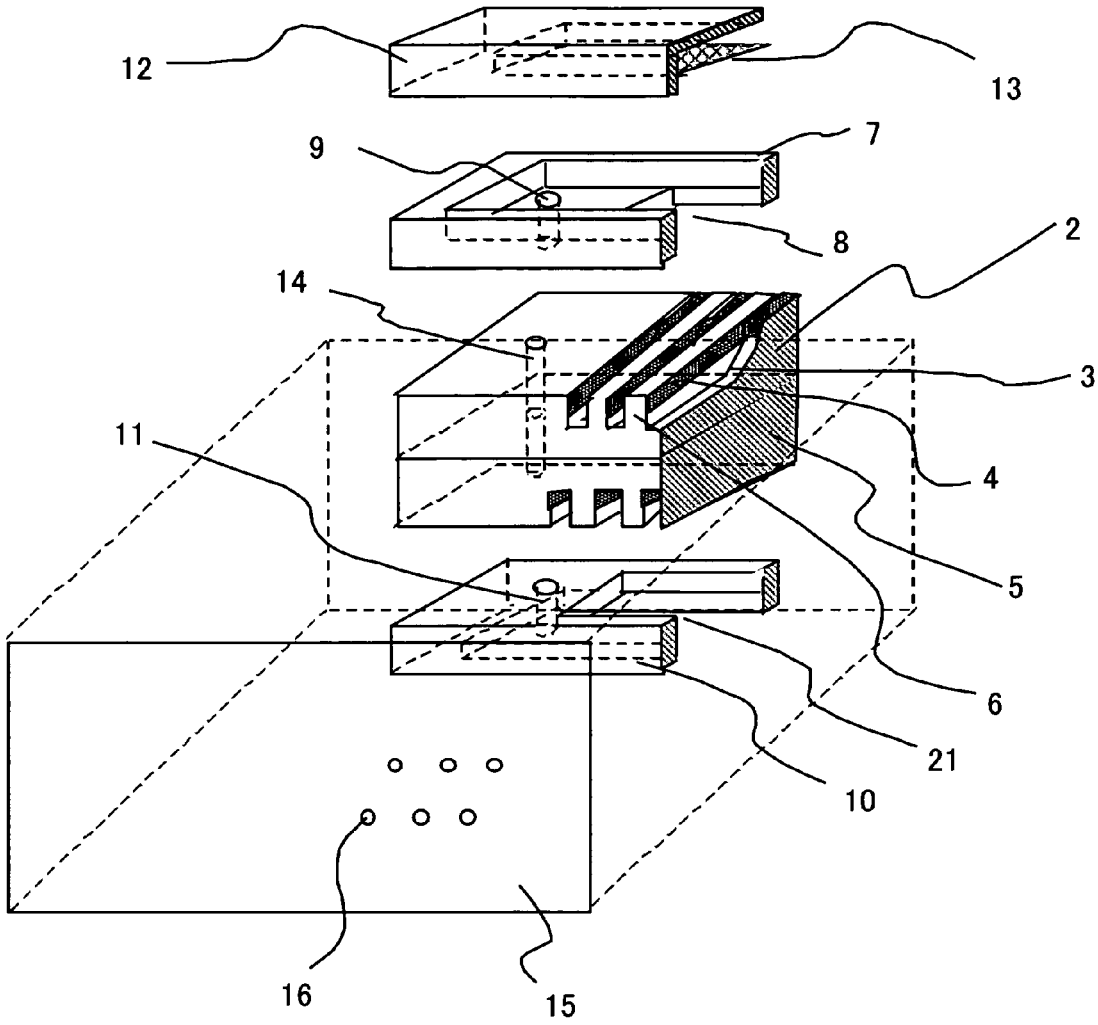
FIG. 3 is an exploded diagram showing the periphery of the discharge pressure generator of the ink jet head according to the first embodiment.
Figure 4A:
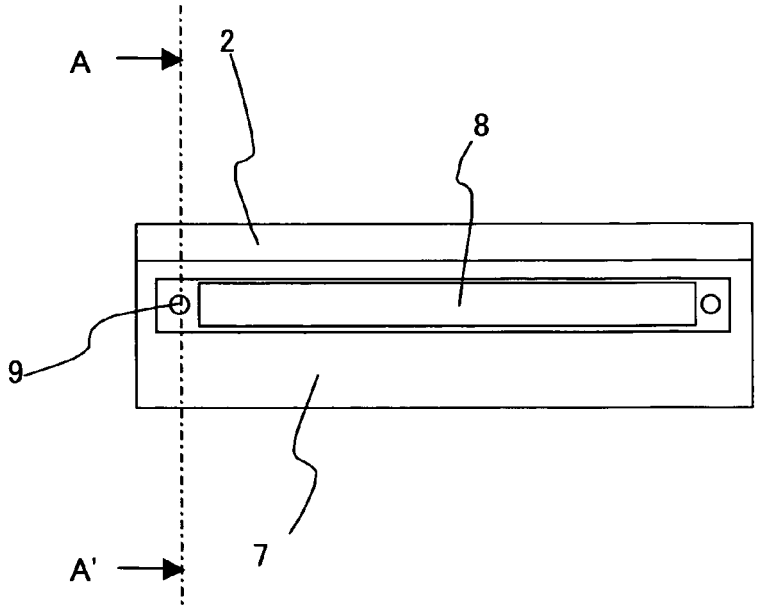
FIGS. 4A and 4B are a plan view and a cross-sectional view of the head chip block of the ink jet head according to the first embodiment, taken along a line indicated by arrows A-A'.
Figure 4B:
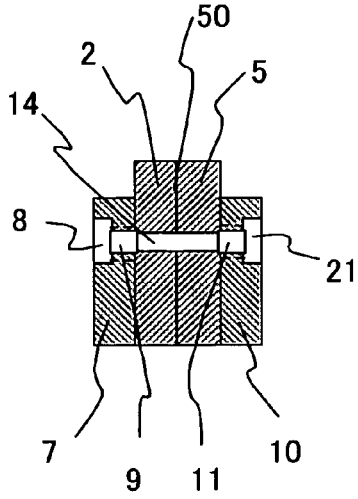
Figure 5:
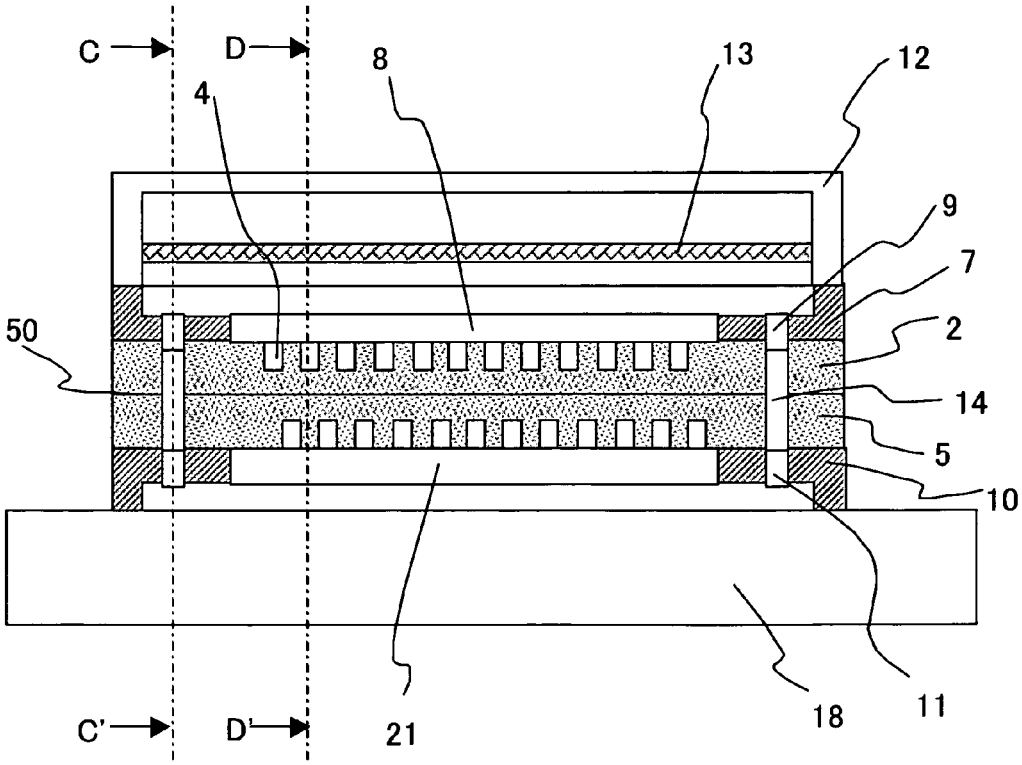
FIG. 5 is a schematic front view of the essential portion of the ink jet head according to the first embodiment.
Figure 6:
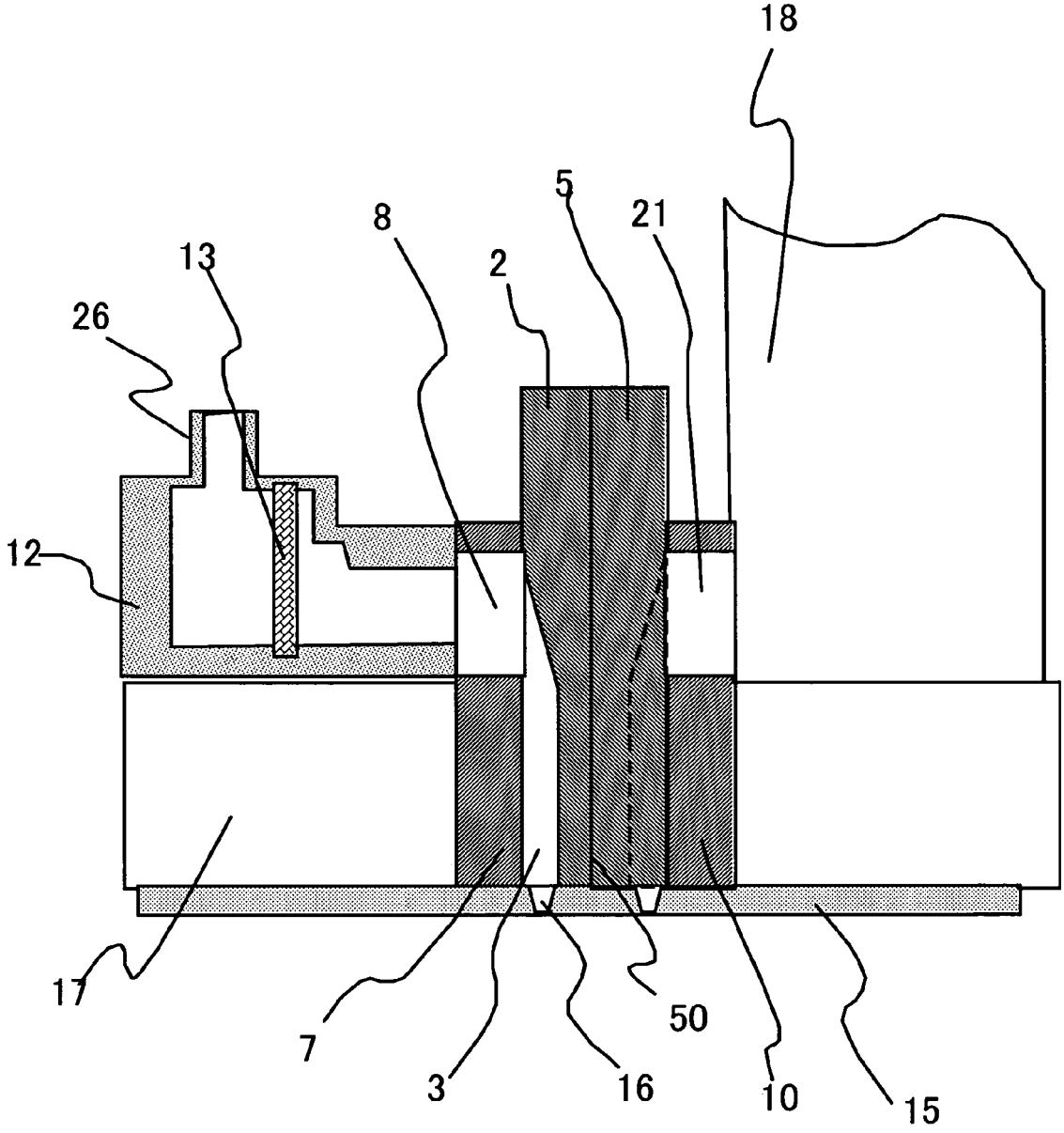
FIG. 6 is a cross-sectional view for the first embodiment, taken along a line indicated by arrows C-C' in FIG. 5.
Figure 7:
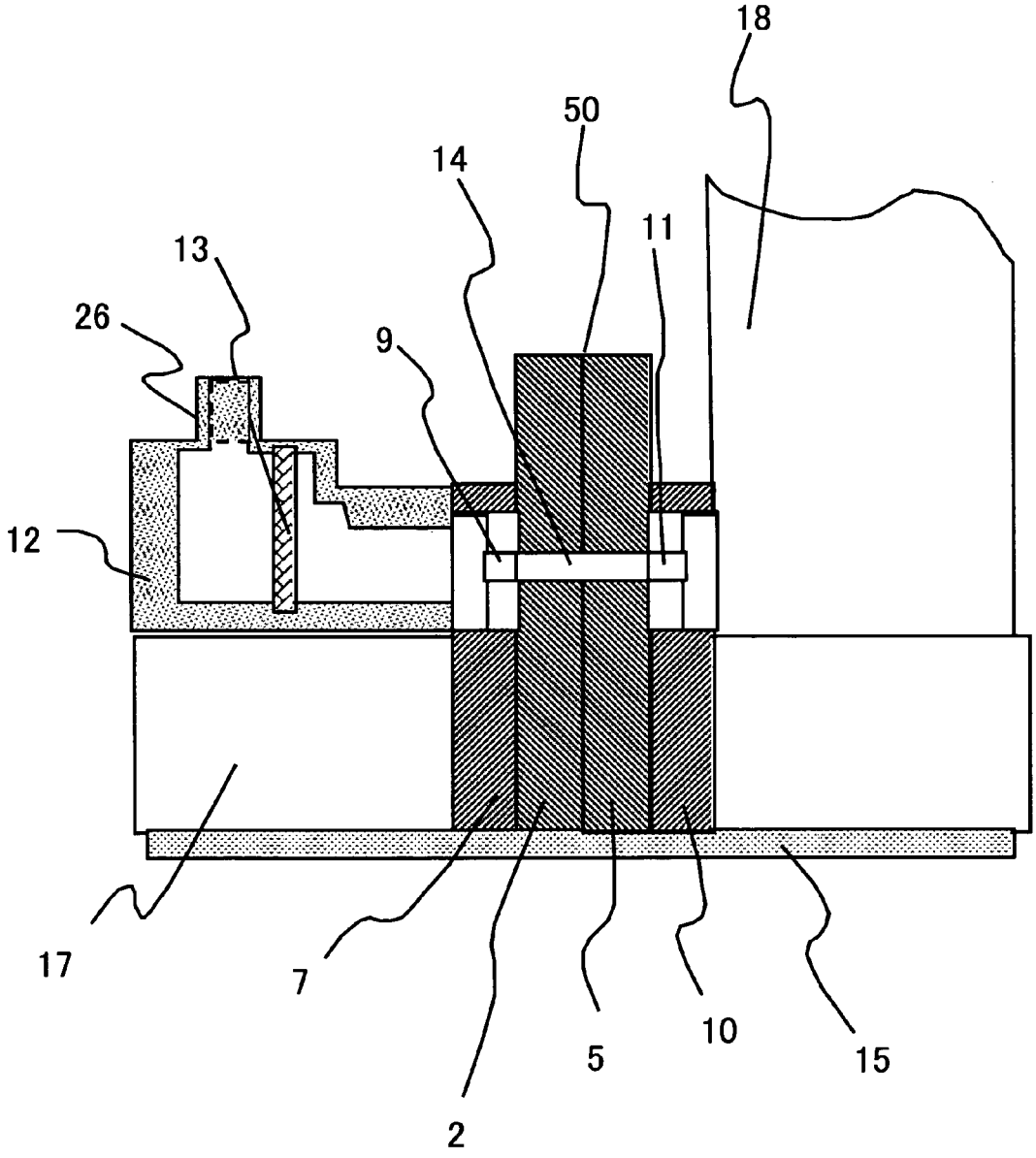
FIG. 7 is a cross-sectional view for the first embodiment, taken along a line indicated by arrows D-D' in FIG. 5.

FIG. 1 is a front view of the entire ink jet head according to a first embodiment of the present invention, and FIG. 2 is a schematic cross-sectional view of the entire ink jet head according to the first embodiment. FIG. 3 is an exploded diagram showing the periphery of the discharge pressure generator of the ink jet head for the first embodiment. FIG. 4A is a plan view of the head chip block of the ink jet head of the first embodiment, and FIG. 4B is a cross-sectional view of this head chip block, taken along the line indicated by arrows A-A'. FIG. 5 is a schematic front view of the essential portion of the ink jet head for the first embodiment, and FIGS. 6 and 7 are a cross-sectional view taken along the line indicated by arrows C-C', and a cross-sectional view taken along the line indicated by arrows D-D'.

As shown in these drawings, an ink jet head 1 for the first embodiment includes: a head chip block 50; an ink flow path 12, formed on one side; a circuit board 22, on which a drive circuit for driving a head, for example, is mounted; and a pressure relaxing unit 19, for relaxing the change in the pressure in the head chip block 50. These members are fixed to a base 18. The pressure relaxing unit 19 is connected to the ink flow path 12 via a flow path joint 26 located in the center of the ink flow path 12, and guides ink to the head chip block 50.

The periphery of the head chip block 50, which serves as a pressure generation source for discharging of ink, will now be described in detail. In the following description, reference numerals of elements of a first head chip are preceded by the letter "A" and those of a second head chip are preceded by the letter "B". A plurality of grooves 3 that communicate with nozzle holes 16 are, formed in piezoelectric ceramic plates A2 and B5, which are actuator substrates that constitute the head chip block 50. The grooves 3 are separated by side walls 6.

One longitudinal end of each groove 3 is extended to and opens at one end face of the piezoelectric ceramic plate A2 or B5, and the other end is not extended to the other end, so that the depth of the grooves 3 is gradually reduced.

Further, on the side walls 6 of the two widthwise sides for each groove 3, electrodes 4 to which a drive electric field is to be applied are formed in the longitudinal direction, near the opening of the groove 3.

A disc-shaped die cutter, for example, is employed to form the grooves 3 in the piezoelectric ceramic plates A2 and B5, and the shape of the die cutter is used to form the portion wherein the depth is gradually reduced. Further, a well known vapor deposition process, for example, is employed in the oblique direction to form the electrodes 4 on the individual grooves 3. After the electrodes 4 are arranged on the two side walls 6 of each groove 3, near the opening, the electrodes 4 are connected to wiring ends on a flexible board 20. The other wiring ends on the flexible board 20 are connected to a drive circuit on the circuit board 22. Thus, the electrodes 4 are electrically connected to the drive circuit.

Ink holes 14 are formed at two locations outside the grooves 3 in the piezoelectric ceramic plates A2 and B5, respectively. Further, ink chamber holes 9 and 11 are also respectively formed at two locations outside ink chamber plates A7 and B10.

Furthermore, the ink chamber plate A7 and the ink chamber plate B10 are respectively bonded to the major faces of the piezoelectric ceramic plates A2 and B5 where the grooves 3 open. Further, an ink chamber A8 and an ink chamber B21 are respectively formed in the ink chamber plates A7 and B10 in the direction of depth so as to cover all the parallel arranged grooves 3. The assembly consisting of the piezoelectric ceramic plate A2 and the ink chamber plate A7 and the assembly consisting of the piezoelectric ceramic plate B5 and the ink chamber plate B10 are laminated, so that the faces of the piezoelectric ceramic plates A2 and B5, in which the grooves 3 have not yet been processed, are aligned. As a result, the head chip block 50 is obtained, and the ink chamber A8 and the ink chamber B21 are externally located.

In this embodiment, the head chip (the piezoelectric ceramic plate A2 and the ink chamber plate A7) adhered to the ink flow path 12 is regarded as a first head chip, and the head chip (the piezoelectric ceramic plate B5 and the ink chamber plate B10) that is not adhered to the ink flow path 12 is regarded as a second head chip.

Furthermore, in this embodiment, the two head chips 15 are coupled together or integrated to form an ink jet head. However, the present invention is not limited to this. The feature of the invention is that a plurality of head chips are integrated and coupled together, and an ink flow path is formed in at least one of the head chips.

In this embodiment, major faces of the piezoelectric ceramic plates A2 and B10 are bonded together, so that the grooves 3 are arranged in a zigzag manner with their positions staggered or shifted from each other at the same intervals. Further, at the position where these plates A2 and B10 are bonded together, the ink holes 14 and the ink chamber holes 9 and 11 are superimposed and pierce the plates A2 and B10. In this embodiment, the grooves 3 are arranged in a zigzag manner; however, in consonance with the purpose for which used, the piezoelectric ceramic plates A2 and B10 may be bonded together at a position whereat the grooves are superimposed. In addition, in the explanation for this embodiment, the ink holes 14 and the ink chamber holes 9 and 11 have been formed at two places at the ends of the head chip block 50. However, these holes may be formed only at one place, or at more than two locations. The present invention is not limited to the number of through holes. Also, the ink chamber holes 9 and 11 have been formed in one part in the ink chamber plates A8 and B21; however, the holes are not especially limited to these positions.

The ink chamber plates A7 and B10 can be ceramic plates or metal plates; however, while taking into account the deformation that may occur after being bonded to a piezoelectric ceramic plate, a ceramic plate that has a similar thermal expansion coefficient is preferable.

Moreover, the nozzle plate 15 is adhered to the end face of the head chip block 50, which is formed of the piezoelectric ceramic plates A2 and B5 and the ink chamber plates A7 and B10, in which the grooves 3 are opened. And nozzle holes 16 are formed in the nozzle plate 15 at locations corresponding to the grooves 3.

In this embodiment, the nozzle plate 15 is larger than the area of the end face of the head chip block 50 in which the grooves 3 are opened. This nozzle plate 15 is a polyimide film in which the nozzle holes 16 have been formed, for example, by using an excimer laser device. Further, although not shown, a water-repellent film to prevent the attachment of ink is deposited on the face of the nozzle plate 15 opposite the recording material.

A head cap 17 that supports the nozzle plate 15 is adhered to the outer face of the base 18 on the end face side of the head chip block 50 in which the grooves 3 are opened. The head cap 17 is connected to the outer edge of the end face of the assembly that includes the nozzle plate 15, and stably supports the nozzle plate 15. The thus arranged head chip block 50 and the head cap 17 are securely fixed to the base 18.

For the ink chamber plate A7 and the ink chamber plate B10, the ink flow path 12 is bonded to the ink chamber plate A7. A flow path joint 26 is located in the center of the ink flow path 12 and connected to the pressure relaxing unit 19, so that ink is actually supplied through it. Furthermore, in order to remove dust, for example, from ink, a flow path filter 13 having a pore size of eight microns is located along the ink flow path 12, opposite the ink chamber plate A7, in the direction in which the grooves 3 are arranged.

According to the ink jet head of this embodiment, at the initial filling time, for example, ink is supplied to the pressure relaxing unit 19 from an ink tank that serves as an ink supply portion. Further, the ink is guided along the flow path joint 26 to the ink flow path 12. Following this, the ink passes through the flow path filter 13 and reaches the ink chamber plate A7, where part of it is supplied to the ink chamber A8 and is loaded into the grooves 3 in the piezoelectric ceramic plate A2. The other part of the ink passes through the ink chamber holes 9 and the ink holes 14, which are formed at both ends of the ink chamber plate A7, and the ink holes 11, which are formed in both ends of the ink chamber plate B10, and is supplied to the ink chamber plate B21. Thus, the ink is loaded into the grooves 3 in the piezoelectric ceramic plate B5. After the ink has passed through the grooves 3 in the piezoelectric ceramic plates A2 and B5, it reaches the nozzle holes 16. The discharge of ink is then enabled. A detailed method for supplying ink is not described here; however, ink can be supplied either by using pressure-reduction, performed on the nozzle hole 16 side using a suction pump, or by using pressurization, performed on the pressure relaxing unit 19 side using a pressure pump.

As is described above, according to the ink jet head of this embodiment, since the ink supply means constituted by the ink chamber holes 9 and 11 and the ink holes 14 that pierce the head chip block 50 is provided, only one ink flow path 12 need be formed in either the ink chamber plate A7 or the ink chamber plate B10 for ink to be supplied to the grooves 3 in both the piezoelectric ceramic plate A2 and the piezoelectric ceramic plate B5. Therefore, the size and the weight of the ink jet head can be reduced, as can the number of parts, and the ink jet head can be provided at a low cost.

Figure 8:
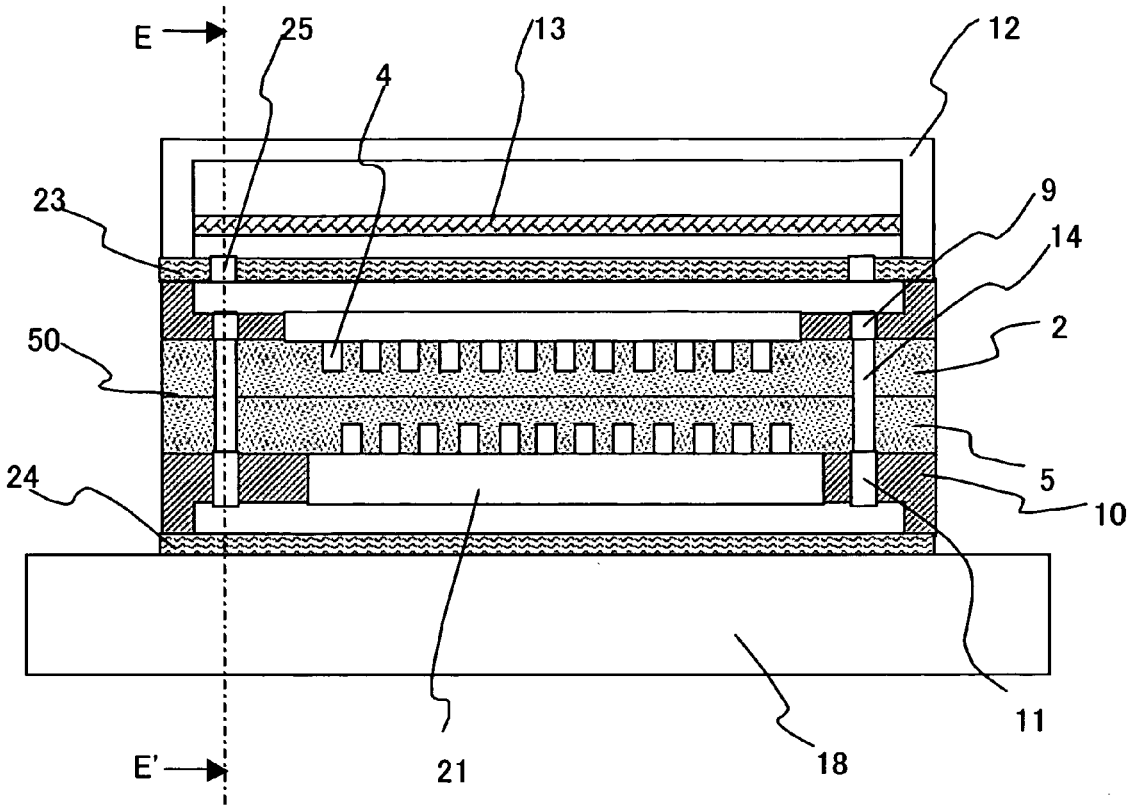
FIG. 8 is a schematic front view of the essential portion of an ink jet head according to a second embodiment of the present invention.
Figure 9:
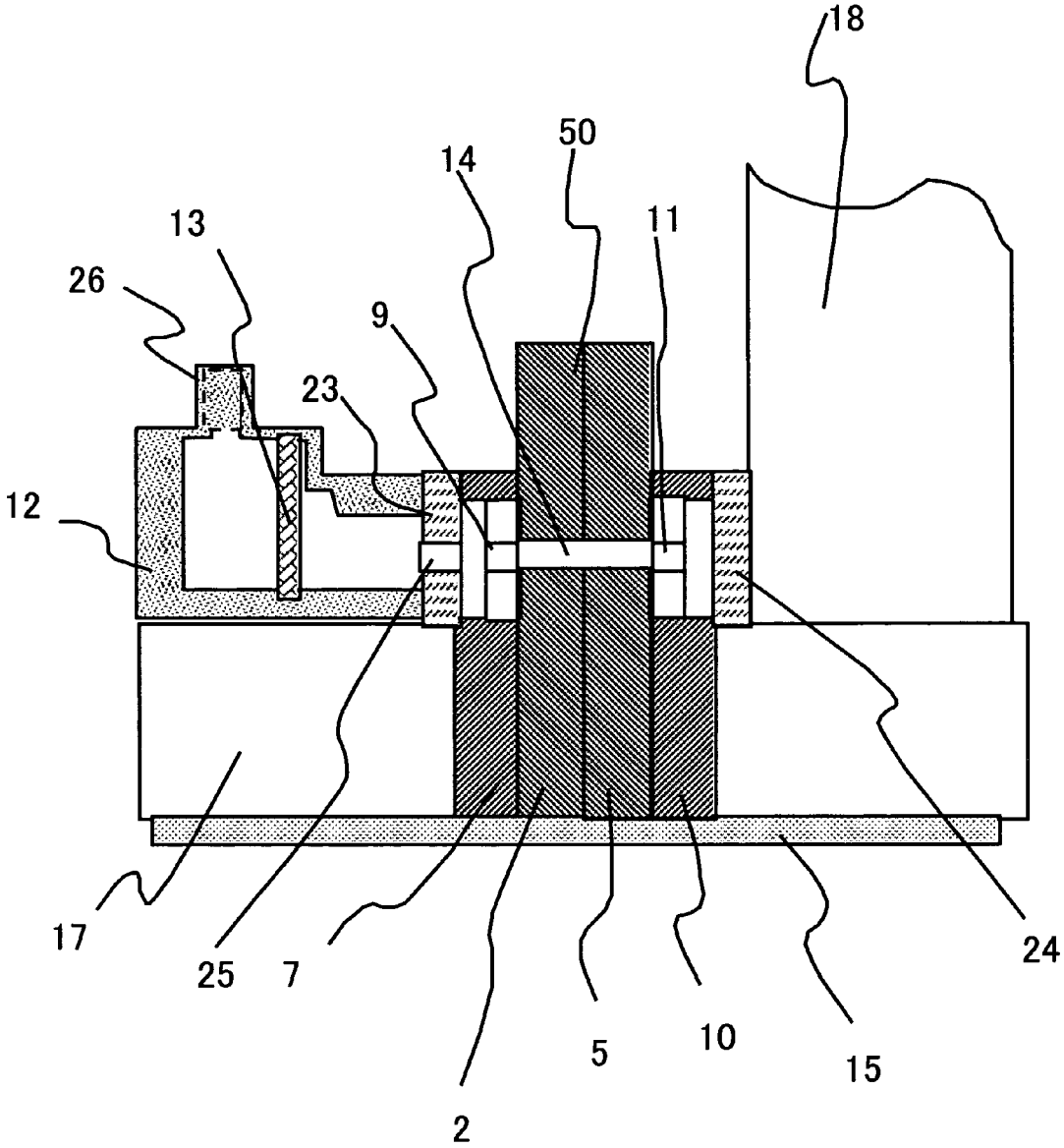
FIG. 9 is a cross-sectional view for the second embodiment, taken along a line indicated by arrows E-E' in FIG. 8.

In association with the ink jet head according to the first embodiment, an explanation will be given for a case wherein a greater improvement in printing uniformity is obtained. FIG. 8 is a schematic front view of the essential portion of an ink jet head according to a second embodiment of the present invention, and FIG. 9 is a cross-sectional view for the second embodiment, taken along the line indicated by arrows E-E' in FIG. 8. As shown in FIGS. 8 and 9, the ink jet head of this embodiment has a structure similar to that provided by the first embodiment, except for the following. In order to provide for ink the same flow resistance between an ink chamber plate A7, to which an ink flow path 12 is bonded, and an ink chamber plate B10, a flow path adjustment plate A23, in which ink guide holes 25 are formed, is bonded to the ink chamber plate A7, and a flow path adjustment plate B24 is bonded to the other ink chamber plate B10. In the ink jet head of this embodiment, for example, at the initial filling time, ink from an ink tank is supplied to a pressure relaxing unit 19, and subsequently is guided to the ink flow path 12 via a flow path joint 26. Furthermore, the ink passes through a flow path filter 13, and fills a space defined by the ink flow path 12 and the flow path adjustment plate A23. Sequentially, the ink passes through the ink guide holes 25 that are formed at both ends of the flow path adjustment plate A23 and reaches the ink chamber plate A7. Part of this ink is guided to the ink chamber A8 and fills the grooves 3 in the piezoelectric ceramic plate A2. The other part of the ink passes through ink chamber holes 9 and ink holes 14, which are formed at both ends of the ink chamber plate A7, and ink chamber holes 11, which are formed at both ends of the ink chamber plate B10. Then, the ink is guided to an ink chamber B21, which is a space defined by the flow path adjustment plate B24 and the ink chamber plate B10, and is supplied to the grooves 3 in the piezoelectric ceramic plate B5. Therefore, the pressure exerted by the ink flow path 12 can be more uniformly dispersed throughout the space defined by the flow path adjustment plate A23 and the ink chamber A8 and the space defined by the flow path adjustment plate B24 and the ink chamber B21. Thus, a more uniform ink discharge function, performed by driving the piezoelectric ceramic plates A2 and B5, can be provided.

In this embodiment, the flow path adjustment plate B24 has been provided on the ink chamber plate B10. However, the face of the ink chamber plate may be bonded directly to the base 18 to eliminate the flow path adjustment plate B24. With this arrangement, no functional problem is encountered.

Figure 10:
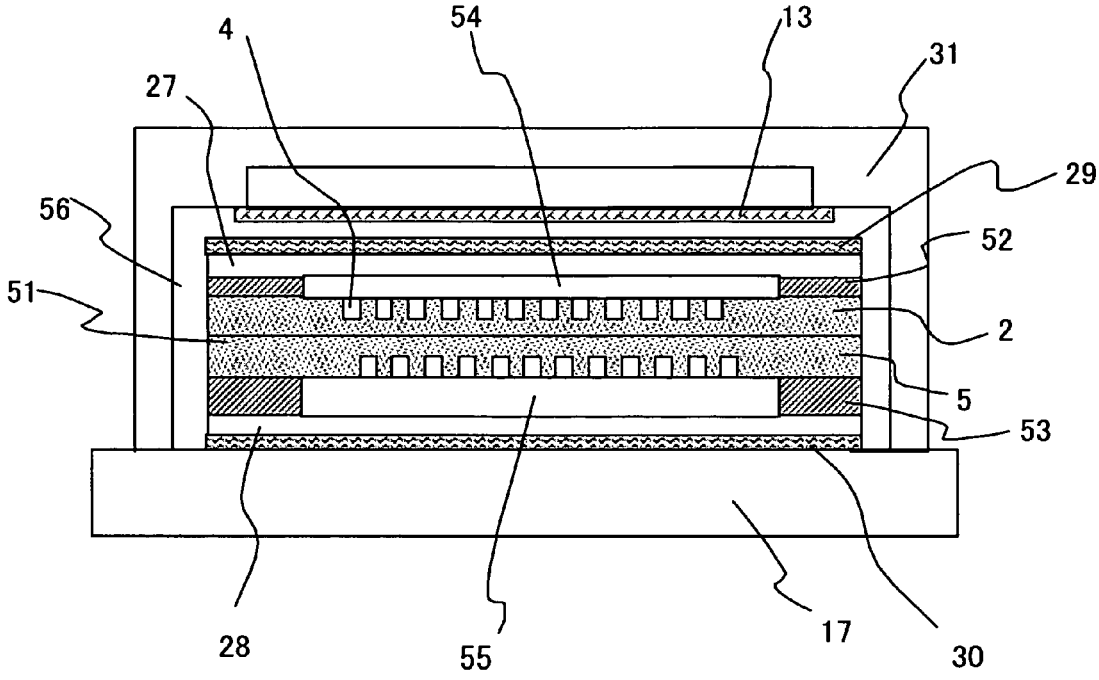
FIG. 10 is a schematic front view of the essential portion of an ink jet head according to a third embodiment of the present invention.
Figure 11A:
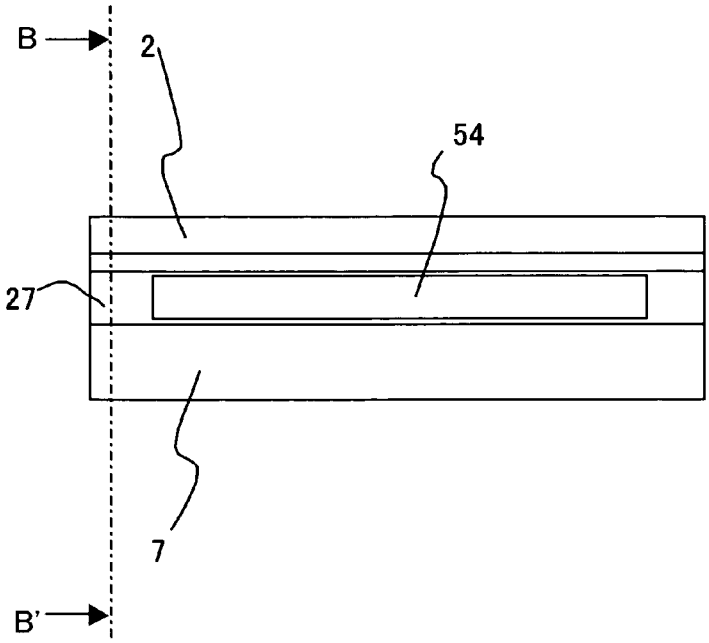
FIGS. 11A and 11B are a plan view and a cross-sectional view of the head chip block of the ink jet head according to the third embodiment, taken along a line indicated by arrows E-E'.
Figure 11B:
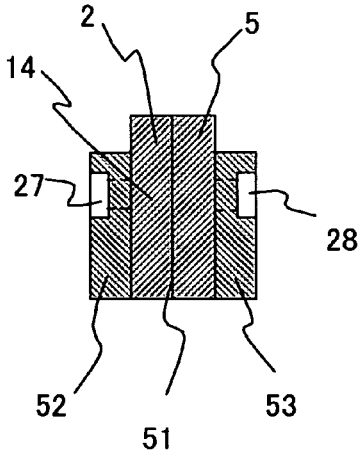
Figure 12:
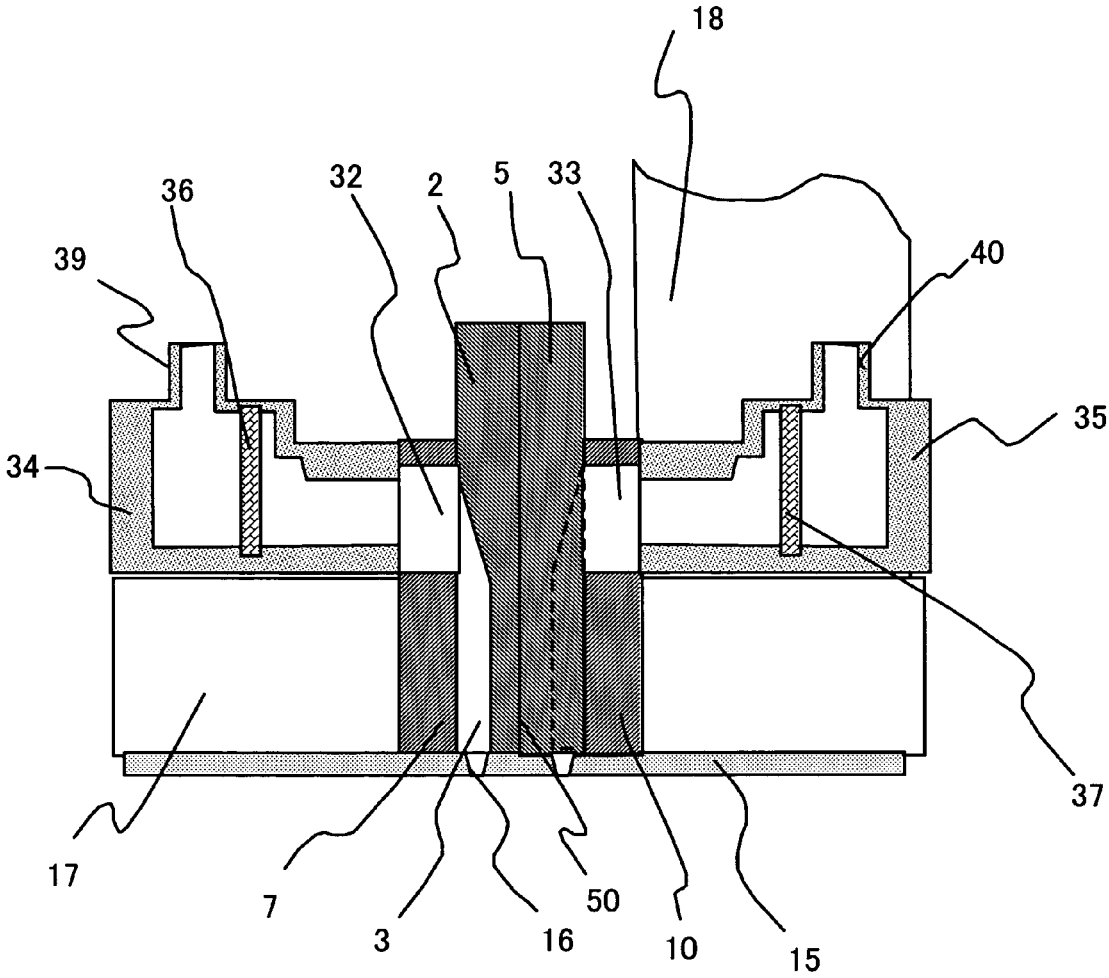
FIG. 12 PRIOR ART
FIG. 12 is a schematic cross-sectional view of the essential portion of a conventional ink jet head.
Figure 13:
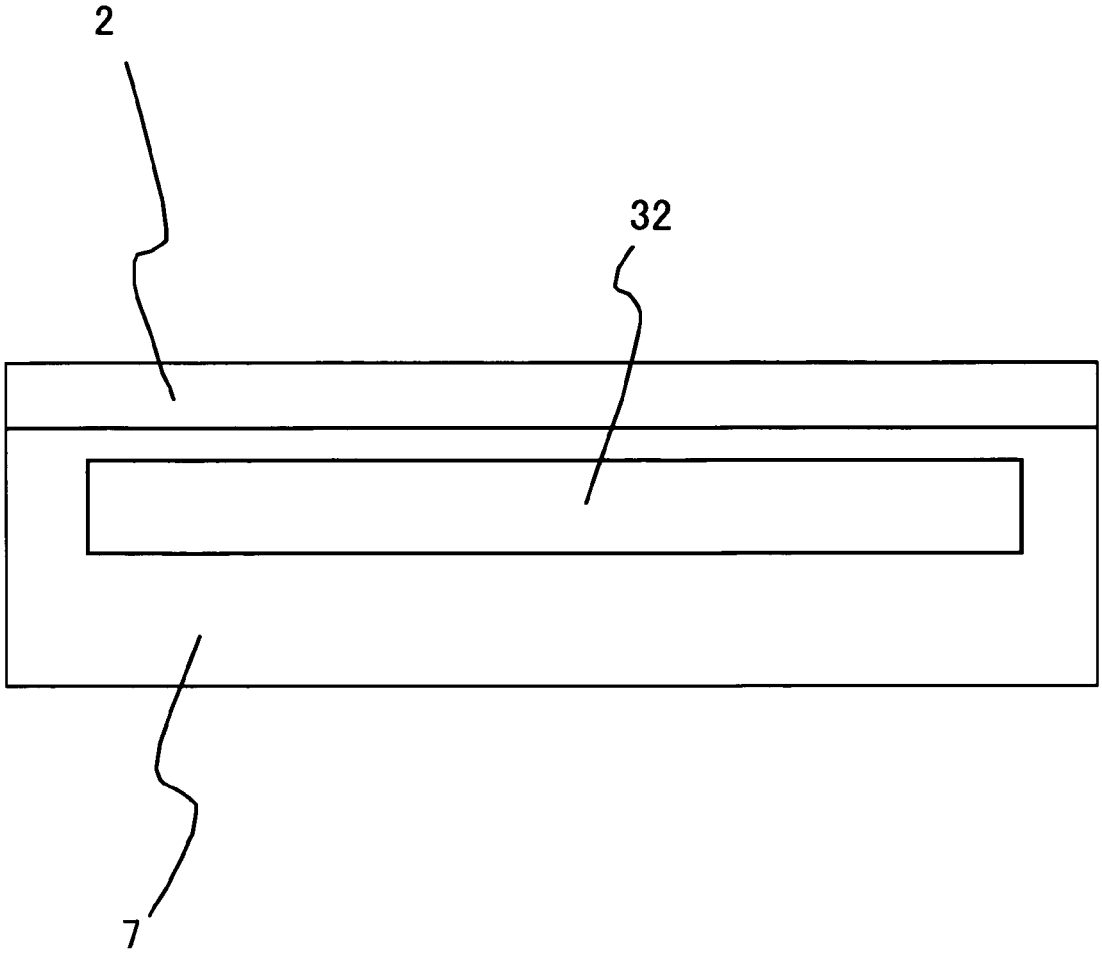
FIG. 13 PRIOR ART
FIG. 13 is a plan view of the head chip block of the conventional ink jet head.
Figure 14:
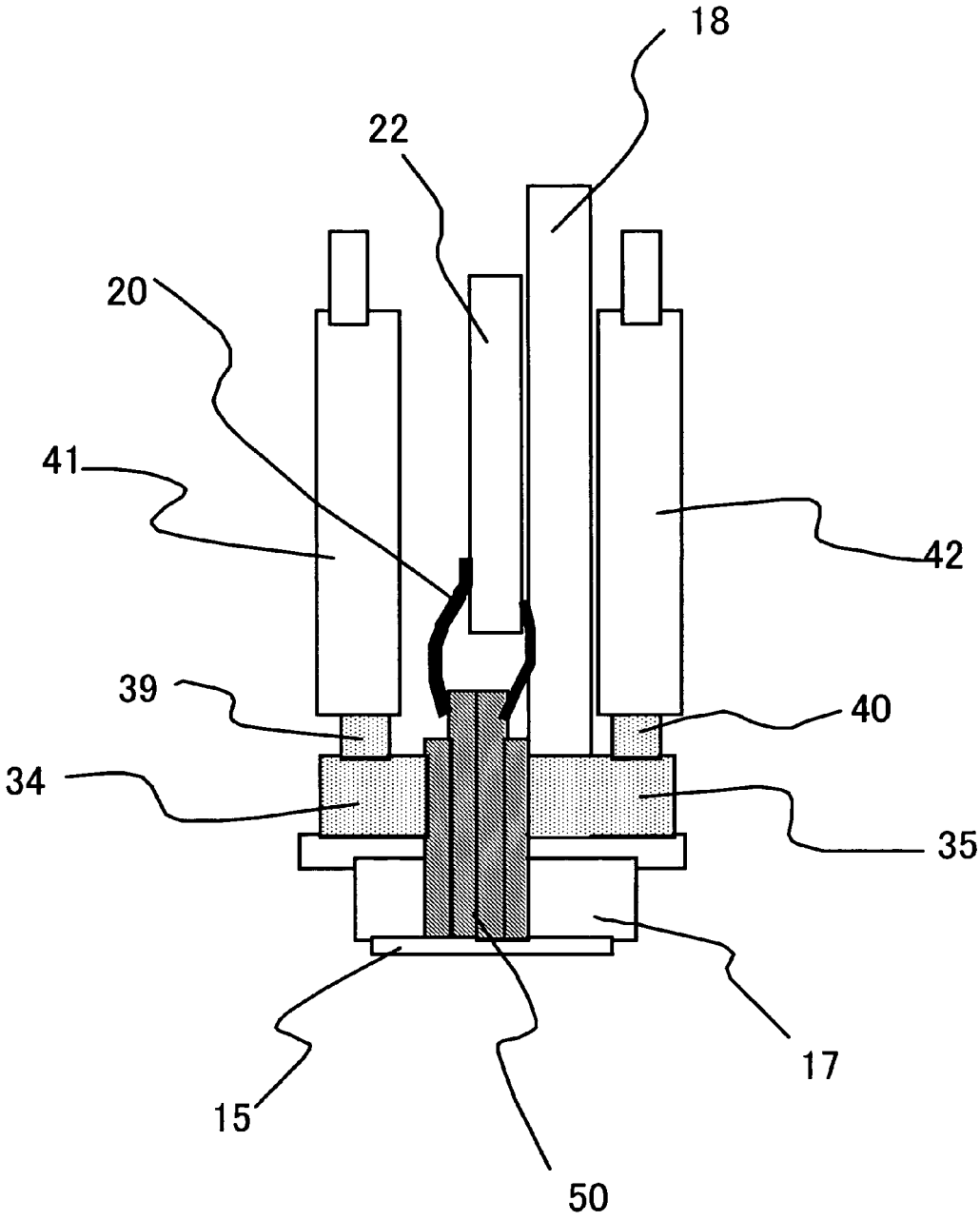
FIG. 14 PRIOR ART
FIG. 14 is a schematic cross-sectional view of the entire conventional ink jet head.

FIG. 10 is a schematic front view of the essential portion of an ink jet head according to a third embodiment of the present invention. FIG. 11A is a plan view of the head chip block of an ink jet head according to the third embodiment, and FIG. 11B is a cross-sectional view taken along the line indicated by arrows B-B'.

As shown in FIGS. 10 and 11, the basic structure of the ink jet head of this embodiment is similar to that of the first embodiment. A difference is that an ink flow path 31 is provided on one side of a head chip block 51, which is a lamination assembly, i.e., different paths are employed to supply ink to two piezoelectric ceramic plates A2 and B5.

A detailed explanation for this ink jet head will be given. An ink chamber plate A52 and an ink chamber plate B53 are bonded to the piezoelectric ceramic plate A2 and the piezoelectric ceramic plate B5 in which grooves 3 are opened. An ink chamber. A54 and an ink chamber B55 are formed by cutting through the ink chamber plate A52 and the ink chamber plate B53 in the direction of the thickness, so that they cover the parallel grooves 3. A chip side groove A27 and a chip side groove B28 are formed outside the ink chambers A54 and B55 to connect an outer portion.

The assembly composed of the piezoelectric ceramic plate A2 and the ink chamber plate A52 and the assembly composed of the piezoelectric ceramic plate B5 and the ink chamber plate B53 are laminated by aligning the faces of the piezoelectric ceramic plates A2 and B5 in which the grooves 3 are not formed. As a result, the head chip block 51 is obtained and the ink chambers A54 and B55 are open to the outside. In this embodiment, the piezoelectric ceramic plates A2 and B10 are bonded, so that the grooves 3 are arranged in a zigzag manner with their positions shifted relative to each other at the same intervals.

Further, an ink chamber cover A29 and an ink chamber cover B30 are bonded to the ink chamber plate A52 and the ink chamber plate B53, so that both sides of the chip side wall groove A27 and the chip side wall groove B28 are open.

For the ink chamber plate A52 and the ink chamber plate B53, an ink flow path or ink passage 31 is bonded from the ink chamber 25 plate A52 side, and the opening formed by the chip side groove A27 and the chip side groove B28 is covered with the two ends of the ink flow path 31.

According to the ink jet head of this embodiment, at the initial filling time, for example, ink from an ink tank is supplied to the ink flow path or ink passage 31, passes through the flow path filter 13 and reaches the ink chamber cover A29. Further, the ink passes along the ink guide path 56 and enters the chip side groove A27 and the chip side groove B28. Sequentially, the ink is guided to the ink chamber A54 and the ink chamber B55, and fills the grooves 3 in the piezoelectric ceramic plates A2 and B5. Thereafter, the ink reaches the nozzle holes 16 and the discharge of ink is enabled. It should be noted that an ink filling method is not described in detail. Ink filling, however, can be performed either by pressure-reduction, performed on the nozzle hole 16 side using a suction pump, or by pressurization, performed on the pressure relaxing unit 19 side using a pressure pump.

As is described above, according to the ink jet head of this embodiment, only one ink flow path 31 need be formed in either the ink chamber plate A52 or the ink chamber plate B53, for ink to be supplied to the grooves 3 in both the piezoelectric ceramic plate A2 and the piezoelectric ceramic plate B5. Thus, the size and weight of the ink jet head can be reduced, as can the number of parts, and the ink jet head can be provided at a low price.

Figure 15:
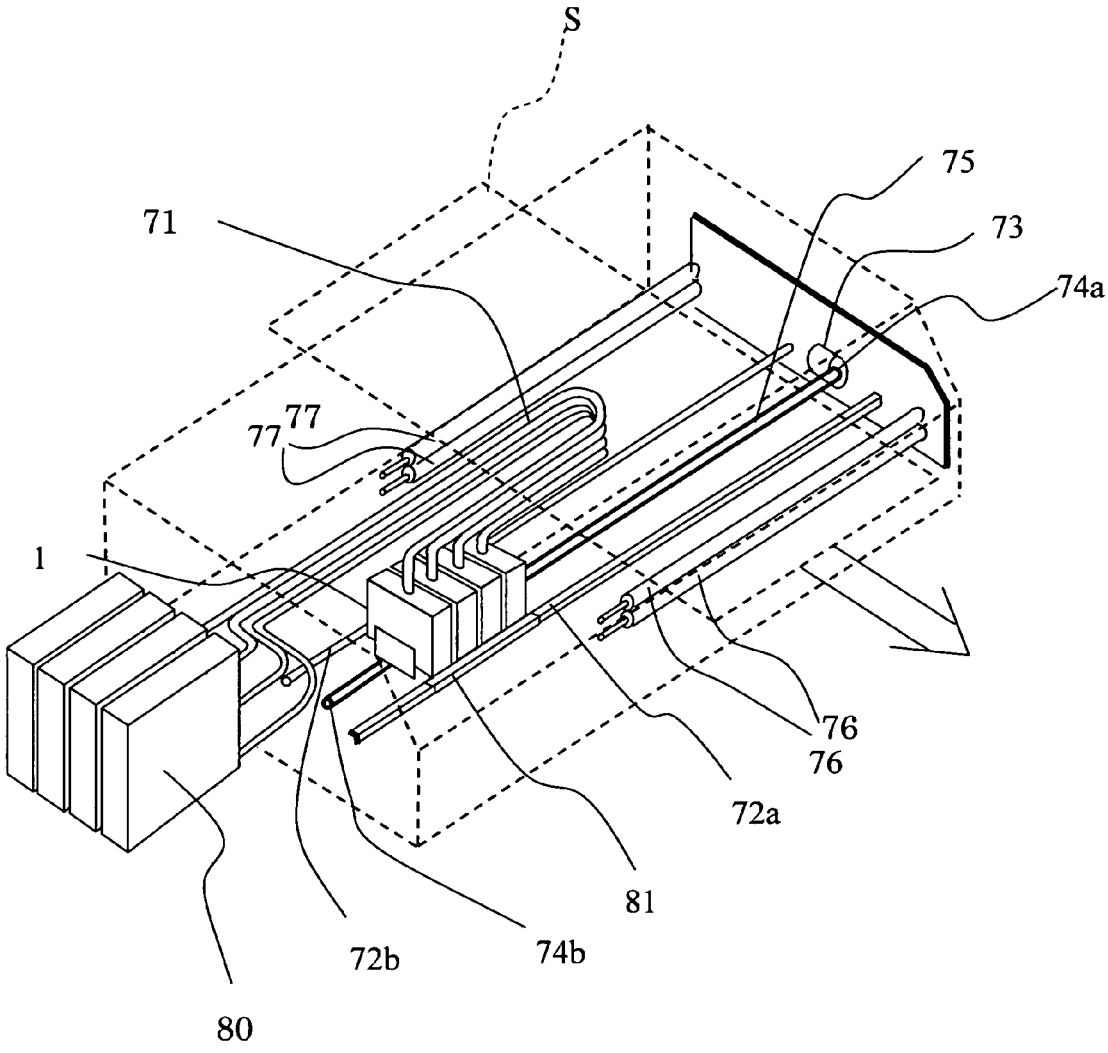
FIG. 15 is a diagram showing an ink jet recording apparatus according to the present invention.

FIG. 15 is a diagram showing an ink jet recording apparatus that employs the ink jet head of this invention. An ink jet head 1 is mounted on a carriage 81 that can be moved along a pair of guide rails 72*a* and 72*b*, in the axial direction, to supply ink, via ink tubes 71, from an ink tanks 80, which are ink supply portions. The ink jet head 1 is moved by a timing belt 75 that is fitted around a pulley 74*a*, which is located at one end of the guide rails 72*a* and 72*b* and is connected to a carriage drive motor 73, and a pulley 74*b*, which is located at the other end. On the sides of the apparatus in the direction perpendicular to that in which the ink jet head 1 is moved, pairs of conveying rollers 76 and 77 are provided along the guide rails 72*a* and 72*b*. These conveying rollers 76 and 77 are used to feed a recording medium S to a position below the ink jet head 1, in the direction perpendicular to the direction in which the ink jet head 1 is moved.

When the above described ink jet recording apparatus conveys the recording medium S and, at the same time, moves the ink jet head in the direction perpendicular to the direction in which the recording medium S is conveyed, characters or images can be recorded on the recording medium S.

What is claimed is:

1. An ink jet head comprising:

a nozzle plate having a plurality of nozzle holes;

a first head chip having a first actuator substrate having a plurality of parallel first grooves that communicate with respective ones of the nozzle holes, and a first ink chamber plate in which is formed a first ink chamber that supplies ink to the first grooves;

a second head chip having a second actuator substrate having a plurality of parallel second grooves that communicate with respective ones of the nozzle holes that are different from the nozzle holes communicating with the first grooves, and a second ink chamber plate in which is formed a second ink chamber that supplies ink to the second grooves;

an ink flow path for connecting an ink supply portion to the first ink chamber; and an ink hole for connecting the first ink chamber to the second ink chamber.

2. An ink jet head according to claim 1, wherein the number of the first head chips is less than the number of the second head chips.

3. An ink jet head according to claim 1, wherein the number of the first head chips is one.

4. An ink jet head according to claim 1, wherein the ink hole is a through-hole formed in a head chip block that constitutes the first and the second head chips.

5. An ink jet head according to claim 1, wherein the ink flow path is a guide hole formed on side faces of the first and the second head chips.

6. An ink jet head according to claim 1, further comprising a flow adjustment plate for equalizing ink flow resistance in the first ink chamber and the second ink chamber.

7. An ink jet recording apparatus comprising:

the ink jet head according to claim 1;

an ink tank for supplying ink to the ink jet head; and a conveying roller for conveying a recording medium onto which ink is discharged by the ink jet head.

8. An ink jet head, comprising:

a first head chip comprised of a first actuator substrate having opposed major faces and plural first grooves formed in one of the major faces, the first grooves each having an open end that opens at a side face of the first actuator substrate, and a first ink chamber plate disposed over the one major face and in which is formed a first ink chamber that opens to the first grooves for supplying ink to the first grooves;

a second head chip comprised of a second actuator substrate having opposed major faces and plural second grooves formed in one of the major faces, the second grooves each having an open end that opens at a side face of the second actuator substrate, and a second ink chamber plate disposed over the one major face and in which is formed a second ink chamber that opens to the second grooves for supplying ink to the second grooves;

a nozzle plate disposed over the side faces of the first and second actuator substrates and having nozzle holes that communicate with the open ends of respective ones of the first and second grooves;

an ink flow path that connects an ink supply portion to the first ink chamber; and an ink passage that connects the first ink chamber to the second ink chamber.

9. An ink jet head according to claim 8; wherein the first and second head chips are integrated to constitute a head chip block.

10. An ink jet head according to claim 9; wherein the ink passage comprises one or more ink holes extending through the first and second head chips and communicating the first ink chamber with the second ink chamber.

11. An ink jet head according to claim 9; wherein the other major faces of the first and second actuator substrates are bonded to each other, and the first grooves and the second grooves open outwardly in opposite directions.

12. An ink jet head according to claim 11; wherein the first and second grooves are staggered relative to one another.

13. An ink jet head according to claim 9; wherein the ink flow passage extends along a side of the head chip block and does not extend through the first and second head chips.

14. An ink jet according to claim 9; further including a flow adjustment plate disposed over the first ink chamber and having one or more ink guide holes that communicate the ink flow path with the first ink chamber and for equalizing ink flow resistance in the first and second ink chambers.

15. An ink jet according to claim 8; wherein the ink passage comprises one or more ink holes extending through the first and second head chips and communicating the first ink chamber with the second ink chamber.

16. An ink jet according to claim 8; wherein the other major faces of the first and second actuator substrates are bonded to each other, and the first grooves and the second grooves open outwardly in opposite directions.

17. An ink jet according to claim 16; wherein the first and second grooves are staggered relative to one another.

18. An ink jet according to claim 8; further including a flow adjustment plate disposed over the first ink chamber and having one or more ink guide holes that communicate the ink flow path with the first ink chamber and for equalizing ink flow resistance in the first and second ink chambers.

19. An ink jet head having multiple head chips connected together to define an integrated head chip block, each head chip having a plurality of grooves each of which communicates at one end thereof with a different nozzle hole formed in a nozzle plate, and an ink chamber overlying the plurality of grooves for supplying ink to the grooves; an ink flow path provided in one head chip that connects an ink supply portion to the ink chamber of the one head chip; and an ink passage extending from the ink chamber of the one head chip that is connected to the ink supply source to the ink chamber of each of the other head chips.

20. An ink jet head according to claim 19;

wherein the ink passage comprises one or more ink holes extending through the multiple head chips and communicating the ink chambers thereof with one another.

* * * * *

UNITED STATES PATENT AND TRADEMARK OFFICE

CERTIFICATE OF CORRECTION

PATENT NO. : 7,645,030 B2
APPLICATION NO. : 11/488255
DATED : January 12, 2010
INVENTOR(S) : Osamu Koseki It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 653 days.

Signed and Sealed this

Sixteenth Day of November, 2010

David J. Kappos

David J. Kappos
*Director of the United States Patent and Trademark Office*